US011708244B2

(12) United States Patent
Cambruzzi et al.

(10) Patent No.: US 11,708,244 B2
(45) Date of Patent: Jul. 25, 2023

(54) METHOD FOR PLANNING AND AT LEAST PARTIALLY INSTALLING AN ELEVATOR SYSTEM IN AN ELEVATOR SHAFT

(71) Applicant: Inventio AG, Hergiswil (CH)

(72) Inventors: Andrea Cambruzzi, Zürich (CH); Christian Studer, Kriens (CH); Eliza Olczyk, Lucerne (CH); Oliver Simmonds, Lucerne (CH); Philipp Zimmerli, Harkingen (CH); Raphael Bitzi, Lucerne (CH)

(73) Assignee: INVENTIO AG, Hergiswil (CH)

( * ) Notice: Subject to any disclaimer, the term of this patent is extended or adjusted under 35 U.S.C. 154(b) by 294 days.

(21) Appl. No.: 17/250,658

(22) PCT Filed: Sep. 10, 2019

(86) PCT No.: PCT/EP2019/074016

§ 371 (c)(1),
(2) Date: Feb. 17, 2021

(87) PCT Pub. No.: WO2020/064316

PCT Pub. Date: Apr. 2, 2020

(65) Prior Publication Data

US 2021/0300729 A1 Sep. 30, 2021

(30) Foreign Application Priority Data

Sep. 26, 2018 (EP) ..... 8196895

(51) Int. Cl.
*B66B 19/00* (2006.01)

(52) U.S. Cl.
CPC ..... *B66B 19/00* (2013.01); *B66B 19/002* (2013.01)

(58) Field of Classification Search
CPC ..... B66B 19/00; B66B 19/002
See application file for complete search history.

(56) References Cited

U.S. PATENT DOCUMENTS

| | | | | |
|---|---|---|---|---|
| 4,977,983 | A | 12/1990 | Garrido et al. | |
| 10,745,242 | B2 * | 8/2020 | Studer | B66B 3/02 |
| 2007/0250199 | A1 | 10/2007 | Akasaka et al. | |

FOREIGN PATENT DOCUMENTS

| | | | |
|---|---|---|---|
| CN | 107848767 | A | 3/2018 |
| EP | 1225522 | A1 | 7/2002 |
| EP | 3127847 | A1 | 2/2017 |

(Continued)

*Primary Examiner* — Nirvana Deonauth
(74) *Attorney, Agent, or Firm* — William J. Clemens; Shumaker, Loop & Kendrick, LLP

(57) ABSTRACT

A method for planning and at least partially installing an elevator system in an elevator shaft includes automated installation steps carried out by an automated mounting device. The method steps include: deriving a target layout of the elevator system from target dimensions of the elevator shaft, establishing the installation steps to be carried out by the automated mounting device, checking that the automated installation steps can be carried out by the mounting device, detecting several actual dimensions of the elevator shaft, deriving an actual layout of the elevator system from the target layout and the detected actual dimensions, planning the automated installation steps based upon the actual layout and carrying out the automated installation steps with the mounting device.

16 Claims, 5 Drawing Sheets

(56) References Cited

FOREIGN PATENT DOCUMENTS

| | | | |
|---|---|---|---|
| JP | 2005178948 | A | 7/2005 |
| JP | 2016079009 | A | 5/2016 |
| WO | 2014027142 | A1 | 2/2014 |
| WO | 2015091419 | A1 | 6/2015 |
| WO | 2017016780 | A1 | 2/2017 |
| WO | 2017016782 | A1 | 2/2017 |
| WO | 2017016783 | A1 | 2/2017 |
| WO | 2017167719 | A1 | 5/2017 |
| WO | 2017182396 | A1 | 10/2017 |
| WO | 2018041815 | A1 | 3/2018 |
| WO | 2018095739 | A1 | 5/2018 |
| WO | wo | | 8/2018 |

* cited by examiner

METHOD FOR PLANNING AND AT LEAST PARTIALLY INSTALLING AN ELEVATOR SYSTEM IN AN ELEVATOR SHAFT

FIELD

The invention relates to a method for planning and at least partially installing an elevator system in an elevator shaft wherein automated installation steps are carried out by an automated mounting device.

BACKGROUND

Production of an elevator system and in particular an installation to be carried out therewith of components of the elevator system within an elevator shaft in a building can lead to a lot of effort and thus high costs, since a large number of components have to be mounted at different positions within the elevator shaft.

Installation steps by means of which, for example, a component is installed within the elevator shaft as part of an installation process have so far usually been carried out by fitters or installation personnel. Typically, a fitter goes to a position within the elevator shaft at which the component is to be installed and installs the component at a desired location, for example by drilling holes in a shaft wall and fastening the component to the shaft wall using screws or bolts screwed or inserted, respectively, into these holes. The fitter can use tools and/or machines for this purpose.

In order to reduce costs and relieve fitters of work that is hazardous to health in the elevator shaft, individual installation steps can be carried out in an automated manner, for example by means of an automated mounting device. The mounting device can, for example, drill holes at established positions on the shaft walls of the elevator shaft and insert tie bolts into the drilled holes. The following working steps, such as aligning and attaching guide rails by means of rail brackets and the aforementioned tie bolts, can then be carried out by a fitter. Rail brackets usually have a rail bracket lower part and a rail bracket upper part that can be screwed to the rail bracket lower part. The rail bracket lower part is fixed, for example screwed, to the shaft wall. The guide rail is connected to the rail bracket upper part, which can be moved relative to the rail bracket lower part. This makes it possible to align the guide rail. The division of labor between the automated mounting device and the fitter can differ in this case.

WO 2017/016783 A1 describes an automated mounting device for carrying out an installation process in an elevator shaft of an elevator system and a method for carrying out an installation process using a mounting device of this kind. In this method, a carrier component having a mechatronic installation component is fixed in the elevator shaft at different heights. In this fixed state, the installation component carries out various installation steps, such as drilling holes in a shaft wall of the elevator shaft. WO 2017/016783 A1 mainly focuses on carrying out the installation and does not deal with the planning thereof in more detail.

EP 1 225 522 A1 describes a design system for a product for an elevator that is to be manufactured on the basis of a specific order.

EP 3 127 847 A1 describes a device and a method for determining the position of an installation platform in an elevator shaft.

WO 2017/016780 A1 describes an automated mounting device for carrying out an installation process in an elevator shaft of an elevator system and a method for carrying out an installation process using a mounting device of this kind. In this method, before a bore is made in a shaft wall of the elevator shaft, an image of the position of reinforcements within the shaft wall is created and, on the basis thereof, drilling positions for boreholes are determined.

SUMMARY

In contrast, it is an object of the invention in particular to propose a method for planning and at least partially installing an elevator system in an elevator shaft, which method allows the installation to be carried out as planned.

In the method according to the invention for planning and at least partially installing an elevator system in an elevator shaft, some, in particular not all, installation steps are carried out by an automated mounting device. The installation steps carried out by the automated mounting device are referred to herein as automated installation steps. The method comprises the following method steps, which are carried out in particular, but not necessarily, in the order specified:

- deriving a target layout of the elevator system from target dimensions of the elevator shaft,
- establishing the installation steps to be carried out by an automated mounting device, i.e. establishing the automated installation steps,
- checking that the automated installation steps can be carried out by the mounting device,
- detecting several actual dimensions of the elevator shaft,
- deriving an actual layout of the elevator system from the target layout of the elevator system and the detected actual dimensions of the elevator shaft,
- planning the automated installation steps on the basis of the actual layout of the elevator system and
- carrying out the automated installation steps by means of the mounting device.

In particular, checking that the automated installation steps can be carried out by the mounting device ensures that the planned automated installation steps can actually be carried out. In order to ensure that the planned automated installation steps can be carried out, it also helps if the automated installation steps are planned only after an actual layout of the elevator system has been derived. Changes in the target layout to the actual layout of the elevator system can thus be taken into account when planning the automated installation steps.

After the automated installation steps have been carried out and in particular after the mounting device has been removed from the elevator shaft, the installation of the elevator system is continued by one or more fitters. For example, the fitter aligns guide rails and fixes them to the shaft walls, installs a drive, assembles a car and carries out all the necessary electrical installations. It is also possible for individual installation steps to be carried out by a further automated mounting device.

The mounting device performs some installation steps in an automated manner. In this case, it can only carry out one installation step, for example drilling a hole in a shaft wall, several times at different positions in the elevator shaft, or different installation steps, for example drilling a hole and inserting a tie bolt into the hole. Even if different installation steps are carried out, these are carried out in particular several times at different positions in the elevator shaft.

The mounting device in particular comprises a carrier component and a mechatronic installation component. The carrier component is designed to be displaced relative to the elevator shaft, i.e. within the elevator shaft, for example, and to be positioned at different heights within the elevator shaft.

The installation component is held on the carrier component and is designed to carry out an installation step as part of the installation process in an at least partially automated, preferably fully automated, manner. The installation component is designed as an industrial robot, for example. The mounting device has in particular a displacement device by means of which the carrier component can be moved in the elevator shaft, and a fixing component for fixing, in particular securing, the carrier component in the elevator shaft. The mounting device has in particular a control means for controlling the individual components of the mounting device. The mounting device is designed, for example, in accordance with a mounting device described in WO 2017/016783 A1.

Deriving a target layout of the elevator system from target dimensions of the elevator shaft is carried out in particular by a planner who is supported in particular by a special computer-aided planning tool. The derivation can also take place in a fully automated manner using a corresponding computer-aided tool. The starting point for deriving the target layout is the target dimensions of the elevator shaft, for example the width, depth and height of the elevator shaft, number of floors and dimensions of door cut-outs. The target dimensions of the elevator shaft can be taken from construction plans of the building containing the elevator shaft. It is also possible that the target dimensions of the elevator shaft are derived from a digital building model of the corresponding building. In addition to the target dimensions of the elevator shaft, when deriving the target layout of the elevator system, in particular further specifications such as the desired transport capacity of the elevator system are taken into account. The target layout of the elevator system establishes, for example, the arrangement of a counterweight (next to or behind the elevator car), the size of the elevator car, the type and number of guide rails, the arrangement and configuration of the drive machine and the type and design of a suspension element (e.g. steel cables or belts). The target layout can have a lower level of detail than the actual layout derived therefrom at a later point. It is possible, for example, for only the arrangement of the counterweight and the size of the elevator car to be defined in the target layout.

Establishing the installation steps to be carried out by an automated mounting device is in particular also carried out by a planner. However, this step can also be carried out in a fully automated manner. In this context, the planner also establishes in particular which mounting device is to be used to carry out the automated installation steps. In particular, the planner has the task of planning the installation of the elevator system in such a way that it can be carried out as quickly and/or inexpensively as possible. Depending on the design of the target layout, different installation steps can be carried out in an automated manner. For example, in some cases it can be advantageous to drill holes for fixing guide rails and set corresponding tie bolts only in an automated manner, and in other cases it can be advantageous to drill holes in an automated manner and fix rail bracket lower parts for fixing guide rails to the shaft wall by means of appropriate screws on the shaft wall. Establishing the installation steps carried out in an automated manner also depends on the automated mounting devices available. There may be different designs of mounting devices that can carry out different installation steps at least in part. It is also possible that, for example, due to the dimensions of the elevator shaft, only a certain design of the mounting device can be used, which can also have an influence on establishing the installation steps that are carried out in an automated manner.

It is also possible that establishing the installation steps carried out in an automated manner is independent of the target layout of the elevator system. This is the case, for example, when the same installation steps are always carried out in an automated manner for all possible layouts of elevator systems. For example, it can be established that holes are always drilled by an automated mounting device and that the mounting device also always inserts tie bolts into the drilled holes. This means that it is only necessary to adopt this specification to establish the installation steps that are carried out in an automated manner.

Checking the automated installation steps can be carried out by the mounting device is in particular also carried out by a planner. However, it can also be carried out in a fully automated manner. In the simplest case, the dimensions of the automated mounting device provided are compared with the dimensions of the elevator shaft. In particular, it is checked whether the mounting device can be brought into the elevator shaft, whether a carrier component having an installation component of the mounting device can be displaced in the elevator shaft and whether it is possible to fix the carrier component in the elevator shaft. In particular, the mounting device is designed to be flexible, such that, for example, a fixing component for fixing the carrier component can be adapted to different dimensions of the elevator shaft to a certain extent. Such adaptations are planned or specified in particular as part of this method step. In addition to the checks mentioned, it can be checked whether the installation component can reach all the necessary points in the elevator shaft. Checking whether the automated installation steps can be carried out by the mounting device is carried out in particular on the basis of the target dimensions of the elevator shaft and the target layout of the elevator system. However, it is also possible for the aforementioned check to be carried out on the basis of the actual dimensions of the elevator shaft and the actual layout of the elevator system. It is therefore not absolutely necessary for the aforementioned check to be carried out on the basis of the target layout of the elevator system.

The method steps described so far can be carried out on the basis of the target dimensions of the elevator shaft and thus independently of the real elevator shaft in which the elevator system is to be installed. However, several actual dimensions of the elevator shaft must be detected on or in the elevator shaft. The actual dimensions can be detected by a planner or fitter, for example by hand. For example, the planner or fitter measures the width and depth of the elevator shaft at different heights and/or checks whether the dimensions of the door cut-outs correspond to the target specifications. It is also possible for the entire elevator shaft to be measured using an automated measuring system. The measuring system can be designed, for example, like a measuring system described in WO 2018/041815 A1. The aim of the detection or measurement is to establish any differences to the target dimensions of the elevator shaft. Dimensions of the elevator shaft can also be understood to mean the properties of surfaces, in particular of the shaft walls or also holes and local elevations of the shaft walls. The dimensions of the elevator shaft should also be understood here to mean profiles of reinforcements in the shaft walls of the elevator shaft. In this way, when the actual dimensions are detected, profiles of reinforcements can also be identified and documented by means of a suitable sensor, for example integrated into a digital model of the elevator shaft.

Deriving an actual layout of the elevator system from the target layout of the elevator system and the detected actual dimensions of the elevator shaft is also carried out by a planner, by a fitter, or in a fully automated manner. Here, the aim is in particular to adopt the target layout as the actual layout of the elevator system. For this purpose, it is checked whether the target layout can be implemented in the real elevator shaft defined by the actual dimensions. It is checked, for example, whether the planned size of the elevator car is also compatible with the actual dimensions of the elevator shaft. The check can include, for example, all specifications of the target or actual layout. If this is the case, then the target layout is adopted as the actual layout of the elevator shaft. If this is not the case, adjustments are made to the layout according to the actual dimensions of the elevator shaft. For this purpose, the size of the elevator car can be adapted, for example. In addition, all further specifications of the target or actual layout can be adapted. If the automated mounting device requires reference elements, for example in the form of cords tensioned in the elevator shaft, to determine its position in the elevator shaft, then the position of these reference elements is in particular also determined in this method step.

The planning of the automated installation steps on the basis of the actual layout of the elevator system is also carried out by a planner, by a fitter, or in a fully automated manner. For example,

- the exact positions of holes to be drilled in the shaft walls are established,
- the positions of the carrier components when the individual installation steps are carried out are established,
- it is established which tool is to be used for which installation step, and/or
- the order in which the individual installation steps are carried out is established.

After the planning of the automated installation steps has been completed, these steps are implemented by the automated mounting device. The implementation is started and monitored in particular by a fitter.

After the automated installation steps have been carried out, the mounting device is removed from the elevator shaft and the installation is continued in particular by a fitter by hand or with the assistance of tools.

The aforementioned planners or fitters can be a single person or several different people.

In an embodiment of the invention, a digital model of the elevator shaft is created using the detected actual dimensions of the elevator shaft. This makes it possible to derive the actual layout from the target layout of the elevator system particularly precisely. The actual layout of the elevator system can be integrated into the digital model of the elevator shaft and thus imaged particularly precisely. A digital model of the elevator shaft is to be understood in particular as a CAD model of the elevator shaft, which can also contain additional information. The level of detail of the digital model of the elevator shaft can vary. For example, only some dimensions of the elevator shaft can be measured by hand and the digital model can be created on the basis thereof. However, it is also possible for the entire elevator shaft to be measured very precisely using an automated measuring system and the digital model to be derived from a point cloud generated in the process. The digital model of the elevator shaft can be integrated into a digital building model, construction plans of the building containing the elevator shaft.

In an embodiment of the invention, after the actual layout of the elevator system has been derived, it is checked again that the automated installation steps can be carried out by the mounting device. A second check of the feasibility of the automated installation steps is therefore carried out. This ensures particularly reliably that the automated installation steps can actually be carried out. The feasibility is also ensured if the actual layout of the elevator system differs from the target layout.

In an embodiment of the invention, the mounting device uses a suitable sensor to check whether the installation step can be carried out as planned before carrying out an upcoming installation step. A third check of the feasibility of the installation step is thus carried out. For this purpose, the installation component of the mounting device in particular receives a sensor, for example a laser scanner for distance measurement or a sensor for identifying reinforcements in a shaft wall. Using this sensor, the intended position at which the installation step is to be carried out, i.e. for example a hole is to be drilled and a rail bracket lower part is to be mounted, is examined more closely. The laser scanner can be used, for example, to check whether there are local irregularities, for example holes or edges, in the shaft wall at the intended position which can make the planned implementation of the installation step difficult or impossible. The sensor for reinforcement identification can be used, for example, to check whether a reinforcement extends at the intended position which makes it difficult or impossible to drill a hole at the intended position. The positioning of the sensor and the evaluation of the detected sensor data is carried out in particular by the control means of the mounting device.

If the result of the feasibility check is positive, the installation step is carried out as planned. If the result of the feasibility check is negative, the implementation is re-planned such that the installation step can be carried out and the thus re-planned installation step is then carried out in this way. This ensures that the installation step can be carried out particularly reliably.

If the result of the feasibility check is negative, a local re-planning of the installation step is therefore carried out. In particular, the intended position for carrying out the installation step is shifted within permitted limits so that the installation step can be performed. For example, the intended position is shifted so that an identified reinforcement no longer interferes with the drilling of a hole. A method for identifying reinforcements and establishing drilling positions is described in WO 2017/016782 A1, for example.

It is also possible that, as part of the local re-planning, a decision is made to first carry out another, additional installation step at the intended position and only then to carry out the actually planned installation step. In the additional installation step, for example, an elevation at the predetermined position can be removed by means of a chisel, so that the actually planned installation step can then be carried out without being impaired by the elevation.

In an embodiment of the invention, in the event that re-planning is not possible while adhering to the established requirements, a fitter can establish the implementation of the installation step and start carrying it out. The fitter can thus use his experience to decide that it is justifiable to carry out the installation step without complying with the aforementioned established specifications. An established specification can be, for example, that there may be no reinforcement in the shaft wall in a certain region around a planned drilling position. The mounting device would only perform the installation step, in the form of drilling a hole in the shaft wall, in an automated manner only if this requirement is met. If, however, a reinforcement is still present, for example at the edge of the region mentioned, the fitter can decide to take the risk that the drilling may not be successful and the hole is nevertheless drilled in the intended position.

The fitter can adapt the sequence of implementation with respect to the sequence planned by the mounting device. Said fitter can also use his experience in the sequence of implementation.

The fitter can, for example, change the sequence directly via an input on the control means of the mounting device and start the implementation of the installation step. It is also possible that the control means of the mounting device has an interface via which the fitter can remotely access the control means, for example via a so-called app on a mobile phone, and change the sequence and start the implementation of the installation step.

In an embodiment of the invention, the digital model of the elevator shaft is adapted using the sensor data detected by the aforementioned sensor. This makes it possible to produce a particularly accurate digital model of the elevator shaft. The type of adjustments depends on the type of sensor used. If distances to the shaft wall have been measured by means of the sensor, then the dimensions of the elevator shaft contained in the digital shaft model are adapted locally. If reinforcements of a shaft wall have been detected by means of the sensor, the information regarding the reinforcements is transferred to the digital model of the elevator shaft.

In addition, information regarding the installation steps carried out, such as the position and type of drill holes in shaft walls, can be transferred to the digital model of the elevator shaft.

In an embodiment of the invention, a mounting protocol is created, in an automated manner, for the installation steps carried out in an automated manner. The mounting protocol can be viewed as part of the model of the elevator shaft and thus a building model of the corresponding building. The installation is therefore logged and documented without any additional effort. The mounting protocol can be evaluated and used, for example, in the following installation steps carried out by a fitter. For example, the fitter can get information from the mounting protocol as to which automated installation steps require manual reworking. The mounting protocol can also be saved for documentation purposes. The mounting protocol is created in particular by the control means of the mounting device and stored in such a way that it can be retrieved later. The mounting protocol contains, for example, information regarding the exact positions at which the installation steps were carried out and/or regarding successful or unsuccessful completion of the automated installation steps.

In an embodiment of the invention, when it is checked that an automated installation step can be carried out by the mounting device, a simulation of the automated installation step is carried out. This allows a particularly precise check to determine whether the planned automated installation steps can actually be carried out. A computer-aided simulation tool is used in the simulation mentioned, in which tool the mounting device and the elevator shaft are modeled. A simulation of the individual automated installation steps is then carried out. During the simulation, a check can be carried out, by a planner or in an automated manner, to determine whether the installation steps can actually be carried out or whether there are, for example, collisions between the installation component and the elevator shaft or the carrier component. In addition to the simulation of the automated installation steps, the insertion of the mounting device into the elevator shaft can also be simulated.

In an embodiment of the invention, when the actual dimensions of the elevator shaft are detected, a position is determined by a marking arranged on the elevator shaft. This makes it possible to detect the actual dimensions particularly precisely and in particular to create a precise model of the elevator shaft. The markings can be arranged in the elevator shaft or in or directly next to door cut-outs in the elevator shaft. Detecting and evaluating said markings can also advantageously be carried out independently of the method steps for planning and at least partially installing an elevator system in an elevator shaft.

The markings can, for example, identify building axes, in particular a vertical axis. The digital model of the elevator shaft can be correctly aligned on the basis of the building axes identified by means of the marking. It is also possible for said marking to identify a defined height, for example a so-called meter line. The meter line indicates a vertical distance of 1 m from the upper edge of the finished floor. The correct position of a shaft door of the elevator system can be derived very precisely from this, for example.

In an embodiment of the invention, a reinforcement plan of the shaft walls of the elevator shaft is taken into account when deriving a target layout of the elevator system. The target layout can thus already be derived in such a way that as few problems as possible occur with the reinforcements in the shaft walls when the elevator system is installed. A reinforcement plan contains information as to where and in particular how deep reinforcements extend in the shaft walls. The target layout is thus established, for example, such that no holes have to be drilled where there are reinforcements.

In the shaft walls, so-called reinforcing bars extend in particular vertically, which bars are connected, in the region of ceilings, to horizontally extending reinforcing bars in the ceiling by means of special brackets. This means that there are a particularly large number of reinforcing bars in the shaft walls in the region of the ceilings. It can therefore be advantageous for the guide rails to be established in the target layout in such a way that no rail bracket lower parts have to be fixed to the shaft walls in the region of ceilings. For this purpose, the guide rails can for example have approximately a length which corresponds to a distance between the ceilings of the building in which the elevator shaft is formed. The guide rails can then in particular be fixed such that they always abut one another in the region of a ceiling of the building. Since no rail bracket lower parts have to be arranged at the ends of the guide rails, there is no need to fix the rail bracket lower parts in the region of the ceilings and therefore it is not necessary to drill holes in these regions. In the region of a shaft bottom and a shaft head, guide rails having a suitable length differing from the length of the other guide rails mentioned may have to be mounted. The described distribution of the guide rails in the elevator shaft can also advantageously be carried out independently of the method steps for planning and at least partially installing an elevator system in an elevator shaft.

In an embodiment of the invention, the mounting device is arranged in the elevator shaft in a first installation phase. In this first installation phase, a position of the mounting device is determined by means of a reference element arranged in the elevator shaft and the mounting device carries out automated installation steps. In a second installation phase after the mounting device has been removed from the elevator shaft, a fitter aligns and then fixes guide rails of the elevator system on an alignment element arranged in the elevator shaft. In the first installation phase, a course of the alignment element is determined on the basis of a course of the reference element and the actual layout of the elevator system, and information regarding the course of the alignment element is provided to the fitter. The fitter can thus arrange the alignment element in the elevator shaft very quickly and without having to measure the elevator shaft.

In particular, two reference elements are used in the first installation phase and two alignment elements are used in the second installation phase, all of which are designed in particular as cords and extend mainly in a main extension direction of the elevator shaft.

In this case, the main extension direction of the elevator shaft should be understood to mean the direction in which an elevator car of the fully mounted elevator system is moved. The main extension direction therefore extends in particular vertically, but can also extend so as to be inclined with respect to the vertical, or can extend horizontally. In this case, the main extension direction does not necessarily need to extend along a single straight line over the entire length of the elevator shaft. It is also possible, for example, for the course of the main extension direction to be composed of straight portions, the transition regions of which may also be rounded.

The position of the mounting device, in particular of the carrier component, can be determined, for example, in accordance with a method described in WO 2017/167719 A1. The guide rails can be aligned on the alignment elements, for example, in accordance with a method described in WO 2015/091419 A1.

The information regarding the course of the alignment element can be provided to the fitter in a wide variety of ways. For example, distances between the alignment element and reference element can be output for two different heights and these can be set and measured by hand. A special gage can also be used for setting, on which said distances can be set. If both the reference element and the alignment element are exactly vertical, the output of said distances is sufficient only for one height.

It is also possible that, by means of the installation component, corresponding markings are attached to a shaft wall or to a component that is additionally fixed to a shaft wall, for example a suitable angle plate. These markings can be used to position the alignment element.

The described determination and provision of the information regarding the course of the reference element can also advantageously be carried out independently of the method steps for planning and at least partially installing an elevator system in an elevator shaft.

In an embodiment of the invention, information regarding a current state of the mounting device can be requested via an interface of a control means of the mounting device. The mounting device can thus be monitored and any problems can be identified.

The information mentioned can include, for example, the information as to whether the mounting device is currently carrying out an installation step or is inactive. For example, the current position of the carrier component in the elevator shaft or information regarding the installation steps that have already been carried out and/or are upcoming can be requested. The information is requested in particular remotely, for example via a communication network, in particular the Internet or a local WLAN. The information can be requested, for example, via a so-called app that runs on a mobile phone.

In an embodiment of the invention, if a fault occurs in the automated mounting device, a responsible fitter is informed by the control means of the automated mounting device via said interface. In particular, a notification is actively sent to the fitter for this purpose. The responsible fitter is thus immediately informed of a fault and he does not have to constantly query the state of the mounting device in order to notice the occurrence of a fault.

The aforementioned information or notification can be displayed, for example, by an app on a mobile phone of the responsible fitter and/or the app emits an acoustic alarm. Such notifications are also known as push notifications.

In an embodiment of the invention, the control means of the mounting device can be controlled remotely via an interface. Remote control of the mounting device can be advantageous, for example, if the mounting device has brought itself into a situation from which it cannot remove itself, for example because any possible action would violate some specification.

The remote control can be carried out for example by a fitter using the aforementioned app. For example, the remote control can be used to start or cancel the implementation of an installation step, to activate or deactivate the fixing of the carrier component or to move the carrier component in the elevator shaft.

The described request of information regarding the current state of the mounting device and the described method steps based thereon, such as informing of faults or remote control of the control means, can also advantageously be carried out independently of the method steps for planning and at least partially installing an elevator system in an elevator shaft.

Further advantages, features and details of the invention can be found in the following description of embodiments and with reference to the drawings, in which like or functionally like elements are provided with identical reference signs. The drawings are merely schematic and are not to scale.

DETAILED DESCRIPTION

Figure 1:
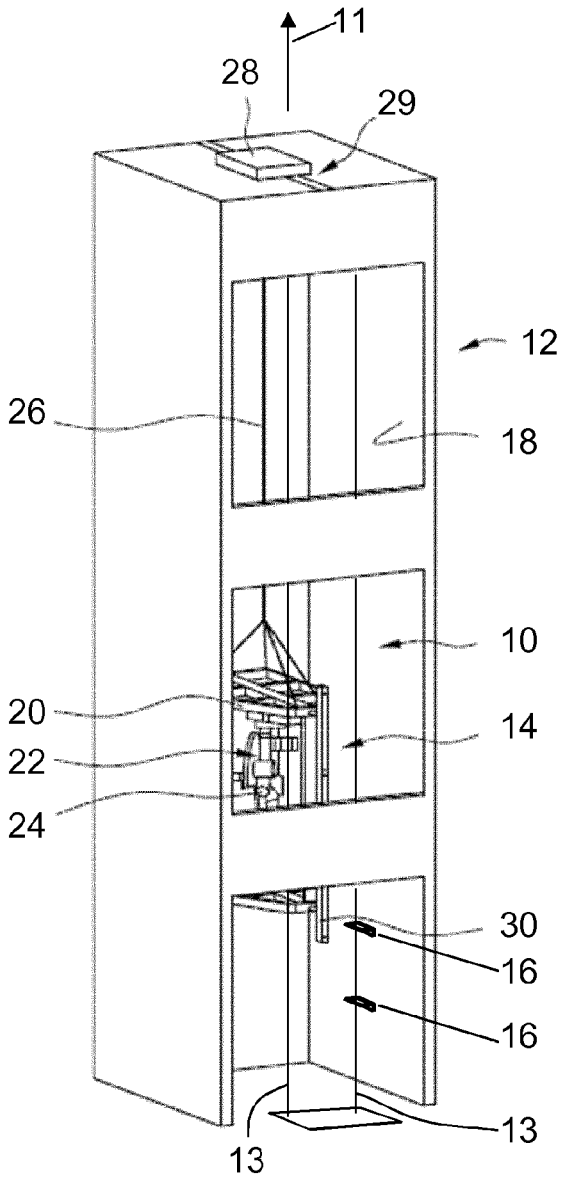
FIG. 1 is a perspective view of an elevator shaft of an elevator system with a mounting device accommodated therein.

First, an example of an automated mounting device is described, which can carry out, in an automated manner, installation steps, i.e. automated installation steps, in an elevator shaft of an elevator system. FIG. 1 shows a mounting device 14 arranged in an elevator shaft 10 of an elevator system 12, by means of which device rail bracket lower parts 16 can be fixed to a shaft wall 18. The elevator shaft 10 extends in a main extension direction 11, which is oriented vertically in FIG. 1. Guide rails (46 in FIGS. 3 and 4; not shown in FIG. 1) of the elevator system 12 can be fixed to the shaft wall 18 via the rail bracket lower parts 16 in a later mounting step. The mounting device 14 has a carrier component 20 and a mechatronic installation component 22. The carrier component 20 is designed as a frame on which the mechatronic installation component 22 is mounted. Said frame has dimensions that permit the carrier component 20 to be vertically displaced within the elevator shaft 10, i.e. for example to move to different vertical positions on different stories within a building. In the example shown, the mechatronic installation component 22 is designed as an industrial robot 24 which is attached to the frame of the carrier component 20 so as to be suspended downwardly. In this case, one arm of the industrial robot 24 can be moved relative to the carrier component 20 and, for example, displaced toward the shaft wall 18 of the elevator shaft 10.

The carrier component 20 is connected, via a steel cable acting as a suspension means 26, to a displacement component 28 in the form of a motor-driven cable winch that is attached at the top of the elevator shaft 10 to a stopping point 29 on the ceiling of the elevator shaft 10. By means of the displacement component 28, the mounting device 14 can be moved within the elevator shaft 10 in the main extension direction 11 of the elevator shaft 10, i.e. vertically over the entire length of the elevator shaft 10.

The mounting device 14 further comprises a securing component 30, by means of which the carrier component 20 can be secured or fixed within the elevator shaft 10 in the lateral direction, i.e. in the horizontal direction.

Two reference elements 13 in the form of cords are tensioned in the elevator shaft 10 over the entire length thereof, which elements are oriented in the main extension direction 11. The reference elements 13 are attached in the elevator shaft 10 by a fitter and are used to determine the position of the mounting device 14, specifically the position of the carrier component 20 in the elevator shaft 10.

Figure 2:
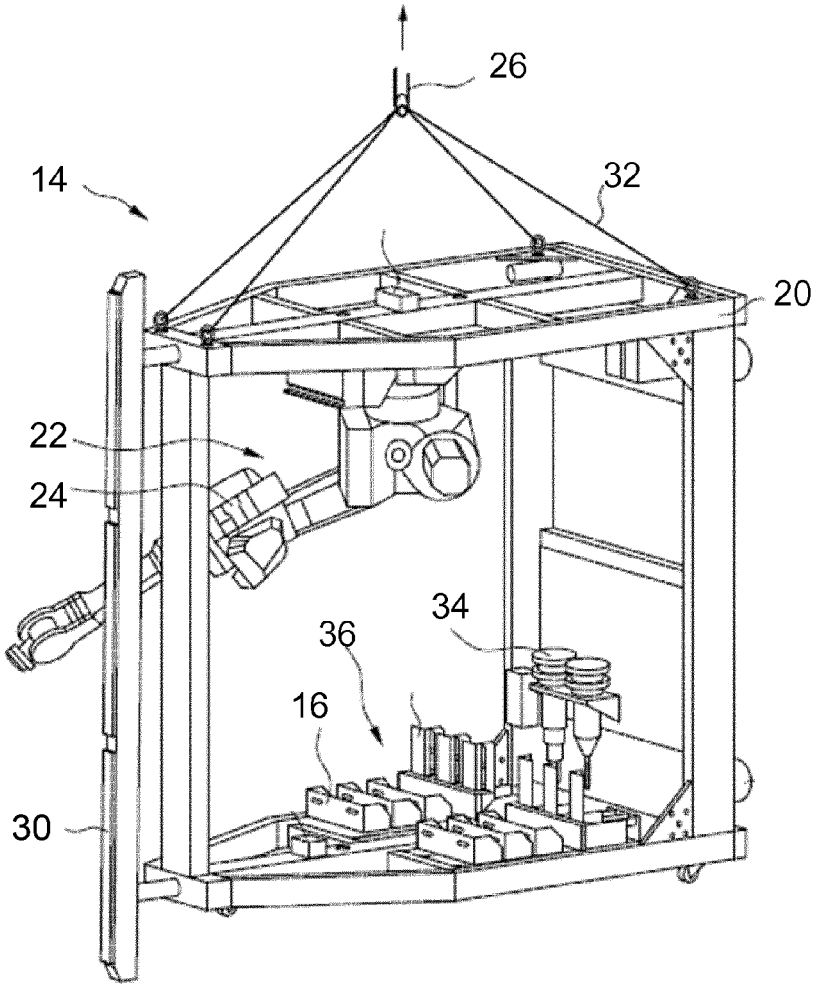
FIG. 2 is a perspective view of a mounting device.

FIG. 2 is an enlarged view of a mounting device 14 without the displacement component 28.

The carrier component 20 is formed as a cage-like frame, in which a plurality of horizontally and vertically extending bars form a mechanically robust structure. Retaining cables 32 are attached to the top of the cage-like carrier component 20, which cables can be connected to the suspension element 26.

In the embodiment shown, the mechatronic installation component 22 is formed using an industrial robot 24. In the example shown, the industrial robot 24 is equipped with a plurality of robotic arms that are pivotable about pivot axes. The industrial robot may, for example, have at least six degrees of freedom, i.e. a mounting tool 34 guided by the industrial robot 24 can be moved with six degrees of freedom, i.e., for example, with three degrees of rotational freedom and three degrees of translational freedom. The industrial robot can, for example, be designed as a vertical buckling arm robot, a horizontal buckling arm robot, a SCARA robot or a Cartesian robot, or as a portal robot.

The unsupported end of the robot can be coupled to different mounting tools 34. The mounting tools 34 can differ with regard to their design and their intended use. The mounting tools 34 can be held on the carrier component 20 in such a way that the unsupported end of the industrial robot 24 can be brought toward said tools or sensors and be coupled to one thereof. For this purpose, the industrial robot 24 can have, for example, a tool changing system which is designed such that it allows at least the handling of a plurality of mounting tools 34 of this kind.

One of the mounting tools 34 is designed as a sensor in the form of a laser scanner, by means of which the relative location of the carrier component 20 relative to the reference elements 13 can be defined. This can be carried out, for example, using a method which is described in WO 2017/167719 A1. The position of the carrier component 20 in the elevator shaft 10 can be determined from the relative location of the carrier component 20 in relation to the reference elements 13. Based on the position of the carrier component 20, it can be determined at which points of the shaft wall 18 a rail bracket lower part 16 is to be fastened.

One of the mounting tools 34 is designed as a sensor for reinforcement identification, by means of which reinforcements or the position thereof in the shaft walls 18 can be identified or determined. For this purpose, the sensor for identifying the reinforcement can be displaced along a shaft wall 18 by the industrial robot 24.

One of the mounting tools 34 can be designed as a drilling tool similar to a drilling machine. By coupling the industrial robot 24 to a drilling tool of this kind, the installation component 22 can be designed in such a way that it allows for an at least partially automated controlled drilling of fastening holes in one of the shaft walls 18 of the elevator shaft 10. In this case, the drilling tool may be moved and handled by the industrial robot 24 in such a way that the drilling tool, using a drill, drills holes at a specified position in the shaft wall 18 of the elevator shaft 10, into which holes fastening elements in the form of screws, screw anchors or tie bolts are later inserted in order to secure rail bracket lower parts 16.

A further mounting tool 34 is designed as a screwdriver in order to screw, in an at least partially automated manner, screw anchors or screws into previously drilled fastening holes in the shaft wall 18 of the elevator shaft 10.

A further mounting tool 34 is designed as an impact tool, for example in the form of an impact hammer, in order to drive, in an at least partially automated manner, tie bolts into previously drilled fastening holes in the shaft wall 18 of the elevator shaft 10.

A further mounting tool 34 is designed as a gripper in order to fasten, in an at least partially automated manner, a rail bracket lower part 16 to the shaft wall 18.

A further mounting tool 34 is designed as a marking tool, for example in the form of a milling tool, in order to apply a marking to a shaft wall 18 or to a component mounted on a shaft wall 18, for example a rail bracket lower part 16. This marking can be used in a later installation step, in particular carried out by a fitter, for aligning, for example, alignment elements or guide rails.

A mounting device does not have to have all of the described types of tools 34. In particular, when tie bolts are driven into boreholes by means of an impact tool, a screwdriver for screwing screws into boreholes and a gripper for gripping rail bracket lower parts are not necessary.

A magazine component 36 may also be provided on the carrier component 20. The magazine component 36 can be used to store the rail bracket lower parts 16 to be installed and provide them to the installation component 22. The magazine component 36 can also store and provide screw anchors, screws or tie bolts that can be inserted into prefabricated fastening holes in the shaft wall 18 by means of the installation component 22.

In the example shown, the industrial robot 24 can, for example, automatically grasp a screw from the magazine component 36 and, for example, drive it incompletely into previously drilled fastening holes in the shaft wall 18 using a mounting tool 34 designed as a screwdriver. A mounting tool 34 on the industrial robot 24 can then be changed and, for example, a rail bracket lower part 16 can be gripped from the magazine component 36. The rail bracket lower part 16 has fastening slots. When the rail bracket lower part 16 is brought into an intended position using the installation component 22, the previously partially screwed-in screws can engage in these fastening slots or extend through them. The mounting tool 34, which is designed as a screwing device, can then be reconfigured and the screws tightened.

After all the rail bracket lower parts 16 have been fixed to the elevator shaft walls 18, guide rails are brought into the elevator shaft 10 and fixed on the shaft walls 18 by a fitter.

It is also possible that the industrial robot 24 grips tie bolts from the magazine component 36 and drives them into previously drilled fastening holes in the shaft wall 18 using a mounting tool 34 designed as a striking tool. By means of the tie bolts, rail bracket lower parts 16 can be fixed to the shaft wall 18 by a fitter by hand in a later installation step.

The elevator system and the installation of the elevator system in the elevator shaft must be planned before starting the installation. The starting point for planning the elevator system is the target dimensions of the elevator shaft, which can be taken, for example, from construction plans or a digital building model of the building in which the elevator system is to be installed. The construction plans can be used to determine target values for the width, depth and height of the elevator shaft, the number of floors and the dimensions of door cut-outs in the elevator shaft. From these target dimensions of the elevator shaft, a planner derives a target layout of the elevator system using a computer-aided tool. He therefore establishes in particular the arrangement of a counterweight (next to or behind the elevator car), the size of the elevator car, the type and number of guide rails, the arrangement and configuration of the drive machine and the type and design of a suspension element (e.g. steel cables or belts).

Figure 3:
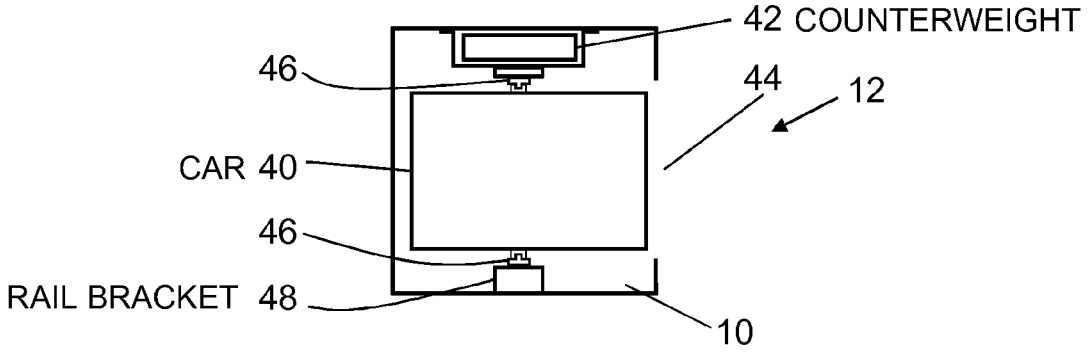
FIG. 3 is a view from above of a simplified layout of an elevator system.
Figure 4:
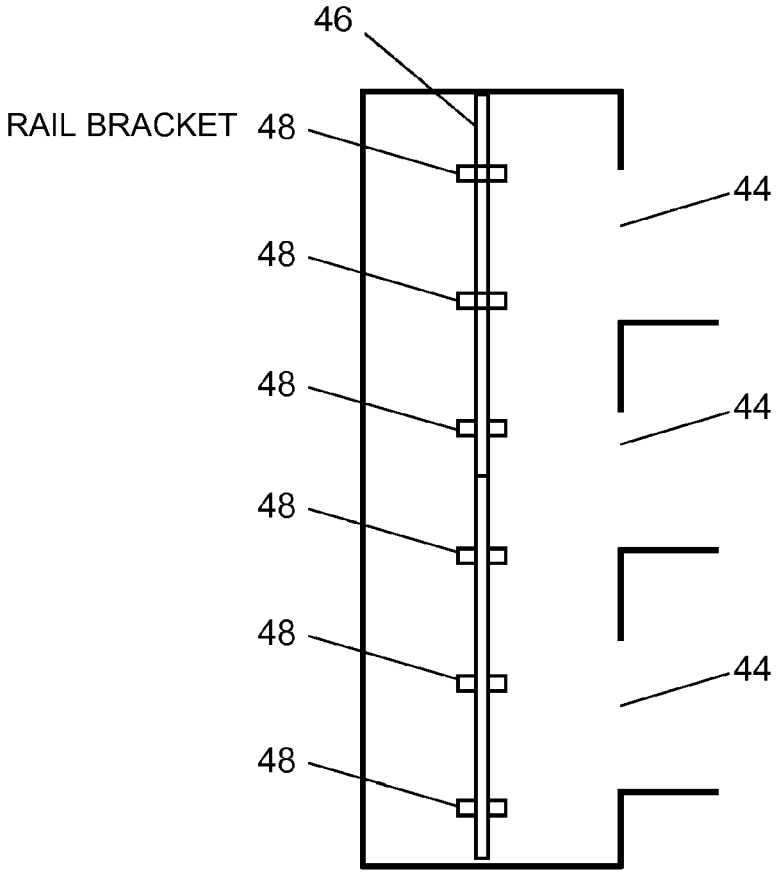
FIG. 4 is a side view of a simplified layout of an elevator system.

A highly simplified target layout of an elevator system 12 is shown in FIGS. 3 and 4. In the target layout, the dimensions of an elevator car 40 (shown only in FIG. 3), the arrangement of a counterweight 42, the positions of guide rails 46 and the positions of rail brackets 48 are established. In addition to the dimensions of the elevator shaft 10, in particular the positions of the door cut-outs 44 are taken into account. Further specifications in the target layout of the elevator system 12, such as the type and position of the drive machine or the type and arrangement of the suspension element, are not shown in FIGS. 3 and 4.

When deriving a target layout of the elevator system, the planner takes into account in particular a reinforcement plan of the shaft walls of the elevator shaft. The reinforcement plan contains information as to where and in particular how deep reinforcements extend in the shaft walls. The planner establishes the target layout such that no holes have to be drilled where there are reinforcements.

The planner then establishes the automated installation steps, i.e. installation steps to be carried out by an automated mounting device. The choice of automated installation steps depends on a wide variety of factors. At the same time, the planner also establishes which mounting device should be used to carry out the automated installation steps. On the one hand, the planner must take into account which automated mounting devices are actually available at the time of installation. In addition, the target layout of the elevator system plays a major role, in particular the height of the elevator shaft. Since the introduction of an automated mounting device into an elevator shaft involves a certain amount of effort, the elevator shaft should have a certain minimum height so that the use of an automated mounting device is worthwhile. Since many factors play a role in the selection of the automated installation steps, no generally applicable rules can be specified.

The planner then checks that the automated installation steps can also be carried out by the automated mounting device provided. In the simplest case, the dimensions of the automated mounting device provided are compared with the dimensions of the elevator shaft. In this case, it is checked whether the mounting device can be brought into the elevator shaft, whether the carrier component having the installation component can be displaced in the elevator shaft and whether it is possible to fix the carrier component in the elevator shaft. The mounting device can be designed to be flexible, such that the fixing component for fixing the carrier component can be adapted to different dimensions of the elevator shaft to a certain extent. Such adaptations are planned or specified by the planner as part of this method step.

In particular, the planner carries out a simulation of the automated installation steps. Here, he uses a computer-aided simulation tool in which the mounting device and the elevator shaft are modeled. The planner checks whether the installation steps can actually be carried out or whether there are collisions between the installation component and the elevator shaft or the carrier component. In addition to the simulation of the automated installation steps, the planner also simulates in particular the insertion of the mounting device into the elevator shaft.

After the described check of the feasibility of the automated installation steps, several actual dimensions of the elevator shaft are detected. This step can be carried out only after the elevator shaft has been produced. The actual dimensions of the elevator shaft can be detected in a wide variety of ways. On the one hand, the planner or a fitter can detect some dimensions by hand. The width and depth of the elevator shaft and the dimensions of the door cut-outs are measured at different heights.

Figure 5:
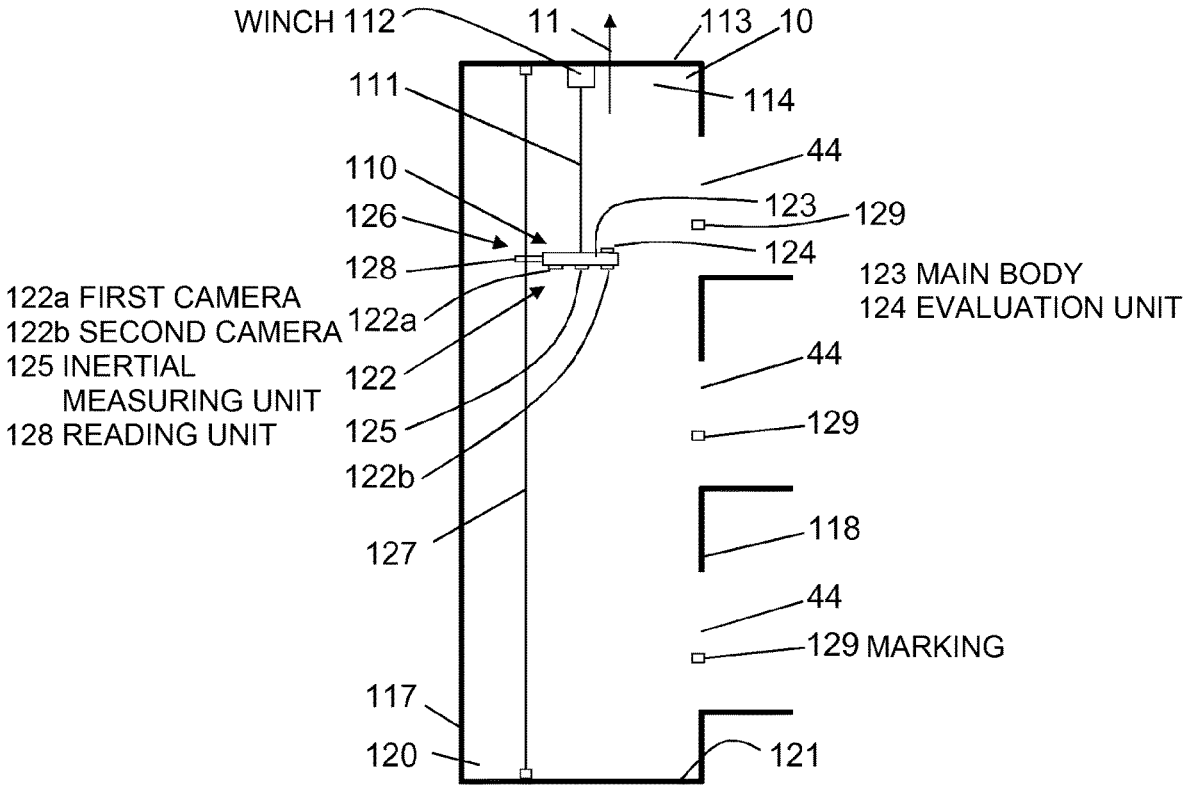
FIG. 5 shows a measuring system when measuring an elevator shaft.

However, it is also possible for the entire elevator shaft to be measured using an automated measuring system. FIG. 5 shows a measuring system 110 when measuring an elevator shaft 10. The optically inertial measuring system 110 is suspended from a shaft ceiling 113 of a shaft head 114 of a mainly cuboid elevator shaft 10 via a suspension element in the form of a cable 111 and a displacement device in the form of a winch 112. The elevator shaft 10 extends in a vertically oriented main extension direction 11 and has a total of four shaft walls, although only one rear shaft wall 117 and one front shaft wall 118 are shown in the side view of FIG. 1. The front shaft wall 118 has a total of three door cut-outs 44 which are arranged one above the other in the main extension direction 11. Shaft doors which close the elevator shaft 10 and allow access to an elevator car are built into the door cut-outs 44 at a later point in time. Opposite the shaft head 114, the elevator shaft 10 has a shaft pit 120 which is closed off by a shaft bottom 121.

The measuring system 110 has a camera system in the form of a digital stereo camera 122 having a first camera 122*a* and a second camera 122*b*. The stereo camera 122 is arranged on a mainly cuboid main body 123 of the measuring system 110 such that it is oriented vertically downward in the direction of the shaft bottom 120 in the suspended state shown. The stereo camera 122 is designed such that, in the state shown, it can capture details of all four shaft walls. The stereo camera 122 is connected by signals to an evaluation unit 124 of the measuring system 110, which receives and evaluates the images captured by the stereo camera 122. The evaluation unit 124 searches the images for distinctive points, for example corners or elevations in one of the shaft walls. As soon as it has identified a distinctive point in both images of the cameras 122*a*, 122*b*, it can use triangulation to determine the position of the distinctive point with respect to the cameras 122*a*, 122*b* and thus with respect to the measuring system 110 from the known distance between the two cameras 122*a*, 122*b* and the different position of the distinctive point in the two images.

An inertial measuring unit 125 is arranged on the main body 123 of the measuring system 110 between the two cameras 122*a*, 122*b*. The inertial measuring unit 125 has three acceleration sensors (not shown), each arranged perpendicularly with respect to one another, and three rotation rate sensors (also not shown), arranged perpendicularly with respect to one another, by means of which the accelerations in the x, y and z directions and the rotational accelerations around the x, y and z axes can be determined. From the measured accelerations, the inertial measuring unit 125 can estimate its position and thus also the position of the measuring system 110 based on a starting position and transmit these positions to the evaluation unit 124 of the measuring system 110. It is also possible for the inertial measuring unit 125 to transmit only the measured accelerations to the evaluation unit 124 and for the evaluation unit 124 to estimate the position of the measuring system 110 therefrom.

For more precise determination of the position of the measuring system 110 in the main extension direction 11 in the elevator shaft 10, the measuring system 110 is coupled to a position determination unit 126. The position determination unit 126 has a position information carrier, oriented in the main extension direction 11, in the form of a code tape 127 which is tensioned between the shaft bottom 121 and the shaft ceiling 113. The code tape 127 has invisible magnetic code marks which represent information regarding the position in the main extension direction 11. The position determination unit 126 also has a reading unit 128 which is arranged on the side of the base body 123 of the measuring system 110 and through which the code tape 127 is passed. The reading unit 128 reads out information in the form of the magnetic code marks of the code tape 127 and can thus determine the position of the reading unit 128 and thus of the measuring system 110 in the main extension direction 11 very precisely. The information read out from the code tape 127 can thus be regarded as additional information regarding the position of the measuring system 110 in the main extension direction 11 with respect to the information from the acceleration and rotation rate sensors of the inertial measuring unit 125.

The position of the measuring system 110 determined by the position determination unit 126 in the main extension direction 11 is regarded as the correct position of the measuring system 110 and thus replaces the position of the measuring unit 110 in the main extension direction estimated by the inertial measuring unit 125. However, it is also possible that a mean value of the two named positions is assumed as the correct position.

From the position of the measuring system 110, determined as described above, and the position of a distinctive point with respect to the measuring system 110, determined by means of triangulation, the evaluation unit 124 determines the absolute position of the distinctive point. The evaluation unit 124 thus determines the positions of a plurality of distinctive points. In order to measure the entire elevator shaft 10, the measuring system 110 is displaced by the winch 112 from top to bottom in the elevator shaft 10.

The positions of the marking 129 on the elevator shaft 10 are also determined using the measuring system 110. In the region of each door cut-out 44, a marking 129 is arranged on each shaft wall. The markings 129 are designed as so-called meter lines, which mark a distance of one meter from the subsequent floor covering. In addition, further markings (not shown in FIG. 5) can be arranged on the elevator shaft, which markings can be detected and evaluated using the measuring system 110. These markings can, for example, identify building axes, in particular a vertical building axis.

A so-called point cloud is created from the positions of the plurality of distinctive points, with each point of the point cloud corresponding to one of the distinctive points. A digital model in the form of a CAD model of the elevator shaft 10 is derived at a later point in time from this point cloud and possibly taking into account the positions of the markings mentioned. The digital model then contains the actual dimensions of the elevator shaft 10.

After the actual dimensions of the elevator shaft have been detected, the planner derives an actual layout of the elevator system from the target layout and the detected actual dimensions of the elevator shaft. The planner primarily checks whether there are deviations between the target dimensions and the actual dimensions of the elevator shaft that make it impossible to adopt the target layout as the actual layout of the elevator system. If this is not the case, the planner adopts the target layout as the actual layout of the elevator system. In the other case, the planner changes the target layout so that he receives an actual layout that can be implemented in the actual dimensions of the elevator shaft.

After the actual layout of the elevator system has been derived, the planner in particular checks again that the automated installation step can be carried out by the mounting device provided. This check takes place analogously to the check described above.

The planner then plans the automated installation steps on the basis of the actual layout of the elevator system. For example,

- the exact positions of holes to be drilled in the shaft walls are established,
- the positions of the carrier components when the individual installation steps are carried out are established,
- it is established which tool is to be used for which installation step, and/or
- the order in which the individual installation steps are carried out is established.

The method steps that prepare the installation of the elevator system in the elevator shaft are thus completed and the installation can be started. For this purpose, one or more fitters introduce the mounting device 14 into the elevator shaft 10 and attach the reference elements 13 in the elevator shaft 10.

Figure 6:
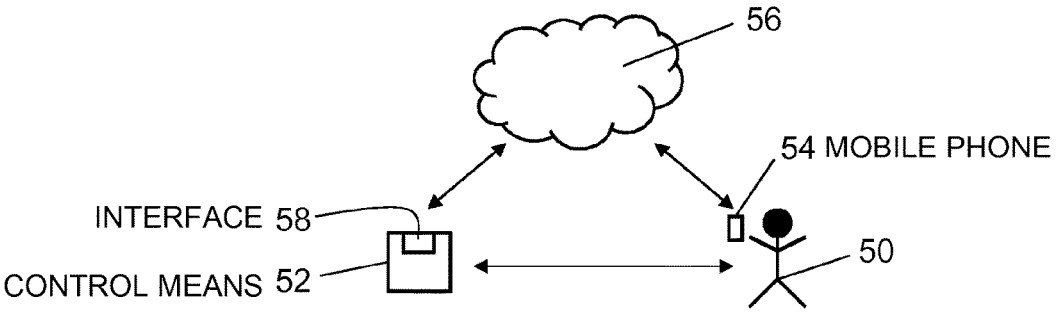
FIG. 6 is a schematic diagram of the communication of a fitter with a control means of a mounting device.

The fitter then starts carrying out the automated installation steps. An interaction or communication of the fitter with the automated mounting device is shown very schematically in FIG. 6. The fitter 50 can start carrying out the automated installation steps directly via an input on a control means 52 of the automated mounting device. Alternatively, the fitter 50 can access the control means 52 via a mobile phone 54, a communication network 56, for example the Internet or a local WLAN, and an interface 58 of the control means 52 and, for example, start carrying out the installation steps. In this way, the fitter 50 can also request information regarding the current state of the mounting device.

The information mentioned can include, for example, the information as to whether the mounting device is currently carrying out an installation step or is inactive. For example, the current position of the carrier component in the elevator shaft or information regarding the installation steps that have already been carried out and/or are upcoming can be requested.

If a fault occurs in the automated mounting device, the fitter 50 is informed by the control means 52 via the interface 58, the communication network 56 and the mobile phone 54. For this purpose, the control means 52 sends a notification, a so-called push notification, to the mobile phone 54 of the fitter 50.

The fitter 50 can control the control means 52 remotely in the aforementioned way. For example, the remote control can be used to start or cancel the implementation of a specific installation step, to activate or deactivate the fixing of the carrier component or to move the carrier component in the elevator shaft.

After starting, the mounting device carries out the automated installation steps automatically. Before certain installation steps are carried out, the mounting device uses a suitable sensor to check whether the installation step can be carried out as planned. In particular, before drilling a hole in a shaft wall, it is checked whether reinforcements are arranged in the shaft wall at the intended position which could make successful completion of the installation step difficult or even impossible. For this purpose, the installation component of the mounting device receives a sensor for identifying reinforcements and checks the intended position for reinforcements. The positioning of the sensor and the evaluation of the detected sensor data is carried out by the control means of the mounting device.

If the result of the feasibility check is positive, the installation step is carried out as planned. If the result of the feasibility check is negative, the implementation is re-planned such that the installation step can be carried out and the thus re-planned installation step is then carried out in this way.

If the result of the feasibility check is negative, the control means of the mounting device carries out a local re-planning of the installation step. The intended position for carrying out the installation step is shifted within permitted limits so that the installation step can be performed. For example, the intended position is shifted so that an identified reinforcement no longer interferes with the drilling of a hole. Identifying reinforcements and establishing drilling positions can be carried out as described in WO 2017/016782 A1, for example.

If re-planning is not possible while adhering to the established requirements, the fitter can establish the implementation of the installation step and start carrying it out. An established specification can be, for example, that there may be no reinforcement in the shaft wall in a certain region around a planned drilling position. The mounting device would only perform the installation step, in the form of drilling a hole in the shaft wall, in an automated manner only if this requirement is met. If, however, a reinforcement is still present, for example at the edge of the region mentioned, the fitter can decide to take the risk that the drilling may not be successful and the hole is nevertheless drilled in the intended position. The communication required for this between the fitter and the control means of the mounting device takes place in particular as described in connection with FIG. 6.

The digital model of the elevator shaft is adapted using the sensor data detected by the aforementioned sensor. If reinforcements of a shaft wall have been detected by means of the sensor, the information regarding the reinforcements is transferred to the digital model of the elevator shaft. In addition, information regarding the installation steps carried out, such as the position and type of drill holes in shaft walls, are transferred to the digital model of the elevator shaft.

The control means of the mounting device creates, in an automated manner, a mounting protocol for the installation steps carried out in an automated manner. The mounting protocol contains, for example, information regarding the exact positions at which the installation steps were carried out and/or regarding successful or unsuccessful completion of the installation steps.

As described in connection with FIG. 1, the mounting device 12 determines the position of the carrier component 20 by means of reference elements 13 arranged in the elevator shaft 10. The phase in which the mounting device 12 performs the automated installation steps can be referred to as a first installation phase.

After all automated installation steps have been carried out and the mounting device has been removed from the elevator shaft, the elevator system is installed by a fitter by hand in a second installation phase. For example, the guide rails have to be aligned and fixed to a shaft wall. To align the guide rails, the fitter can use alignment elements that are arranged in the elevator shaft and designed as cords. The correct course of the alignment elements can be derived directly from the course of the aforementioned reference elements. The information required for this is provided to the fitter by the control means of the mounting device. This can also take place as described in connection with FIG. 6. On the basis of this information, the fitter can install the alignment elements in the elevator shaft in the second installation phase and before aligning the guide rails.

Figure 7:
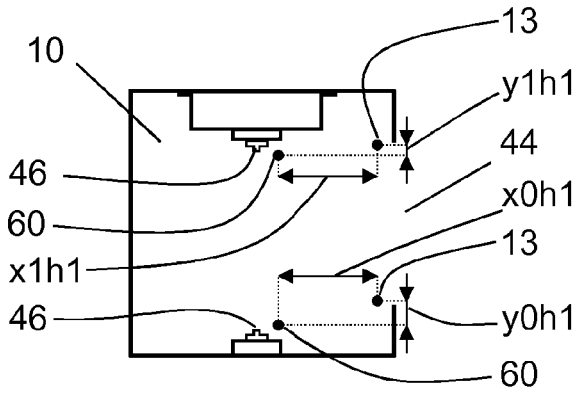
FIG. 7 is a view from above of an arrangement of alignment elements with respect to reference elements in an elevator shaft and FIG. 8 is a side view of an arrangement of alignment elements with respect to reference elements in an elevator shaft.
Figure 8:
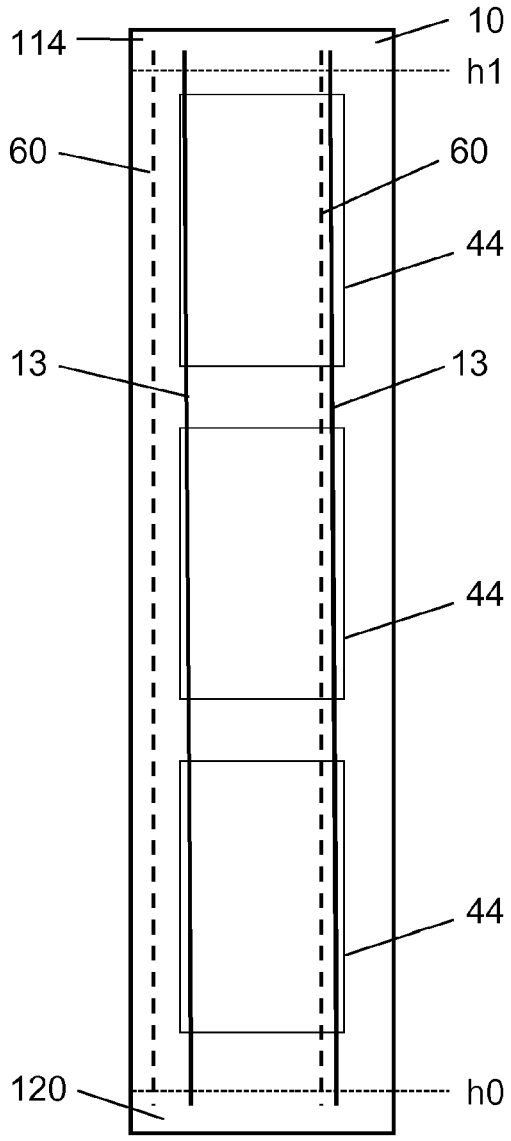

FIGS. 7 and 8 show an example of what information can be provided to the fitter. FIGS. 7 and 8 show two reference elements 13 in the region of a door cut-out 44 in the elevator shaft 10, FIG. 7 showing the situation at a height h1 near the shaft head 114 of the elevator shaft 10. In addition, an alignment element 60 is arranged in the region of the guide rails 46. The alignment elements 60 are spaced apart from the associated reference elements 13 in the x and y directions at distances of x0h1 and y0h1, and x1h1 and y1h1, respectively. The distances x0h1, y0h1, x1h1 and y1h1 are provided to the fitter. The same is done for a height h0 near the shaft pit 120 of the elevator shaft 10. The distances x0h0, y0h0, x1h0 and y1h0 (not shown) at the height h0 are determined in a similar way and provided to the fitter. With these distances x0h0, y0h0, x1h0, y1h0, x0h1, y0h1, x1h1 and y1h1 as well as the information regarding the heights h0 and h1, the fitter can correctly attach the alignment elements 60 in the elevator shaft 10 and then align the guide rails 46 therewith.

Finally, it should be noted that terms such as "comprising", "having," etc. do not preclude other elements or steps and terms such as "a" or "an" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for planning and at least partially installing an elevator system in an elevator shaft, wherein automated installation steps are carried out by an automated mounting device in the elevator shaft, the method comprising the steps of:

providing an automated mounting device having a carrier;

deriving a target layout of the elevator system from target dimensions of the elevator shaft via a computer aided tool;

establishing installation steps to be carried out by the automated mounting device to at least partially install the elevator system in the elevator shaft;

checking that the established installation steps can be carried out by the automated mounting device via a computer-aided simulation tool;

detecting several actual dimensions of the elevator shaft via an automated measuring system, the automated system having a camera;

deriving an actual layout of the elevator system from the target layout of the elevator system and the detected actual dimensions of the elevator shaft via a digital model;

planning automated installation steps on the basis of the actual layout of the elevator system and the established installation steps that can be carried out by the automated mounting device; and carrying out the automated installation steps with the automated mounting device.

2. The method according to claim 1 including creating the digital model of the elevator shaft using the detected actual dimensions of the elevator shaft.

3. The method according to claim 1 including, after the actual layout of the elevator system has been derived, checking again that the established installation steps can be carried out by the automated mounting device.

4. The method according to claim 1 including, before carrying out a next one of the automated installation steps, the automated mounting device checks, using a sensor, whether the next automated installation step can be carried out as planned and wherein:

when a result of the check is positive, the automated mounting device carries out the next automated installation step as planned; and when the result of the check is negative, re-planning an implementation so that the next automated installation step can be carried out and then the automated mounting device carries out the re-planned next automated installation step.

5. The method according to claim 4 including when the re-planning of the next automated installation step is not possible while adhering to established specifications, a fitter establishes implementation of the next automated installation step.

6. The method according to claim 4 including creating the digital model of the elevator shaft using the detected actual dimensions of the elevator shaft and adapting the digital model of the elevator shaft using sensor data detected by the sensor.

7. The method according to claim 1 including automatically creating a mounting protocol for the automated installation steps.

8. The method according to claim 1 including checking that the established installation steps can be carried out by the automated mounting device by carrying out a simulation of the installation steps.

9. The method according to claim 1 including when the actual dimensions of the elevator shaft are detected, determining a position in the elevator shaft by arranging a marking on the elevator shaft.

10. The method according to claim 1 including when the target layout of the elevator system is derived, taking into account a reinforcement plan of shaft walls of the elevator shaft.

11. The method according to claim 1 including the steps of: in a first installation phase, arranging the automated mounting device in the elevator shaft, determining a position of the automated mounting device by a reference element arranged in the elevator shaft, and the automated mounting device carrying out the automated installation steps; and in a second installation phase after removing the automated mounting device from the elevator shaft, a fitter aligns and then fixes guide rails of the elevator system based on an alignment element arranged in the elevator shaft, and a course of the alignment element being determined based on a course of the reference element in the elevator shaft and the actual layout of the elevator system, and wherein information on the course of the alignment element is provided to the fitter in the first installation phase.

12. The method according to claim 1 including requesting information regarding a current state of the automated mounting device via an interface of a control of the automated mounting device.

13. The method according to claim 12 including when a fault occurs in the automated mounting device, a fitter is informed of the fault by the control of the automated mounting device via the interface.

14. The method according to claim 12 including requesting information regarding at least one of completed and upcoming steps of the automated installation steps via the interface of the control of the automated mounting device.

15. The method according to claim 12 including controlling the control of the automated mounting device remotely via the interface.

16. A method for planning and at least partially installing an elevator system in an elevator shaft, wherein automated installation steps are carried out by an automated mounting device in the elevator shaft, the method comprising the steps of:

providing an automated mounting device having a carrier;

deriving a target layout of the elevator system from target dimensions of the elevator shaft via a computer aided tool;

establishing installation steps to be carried out by the automated mounting device to at least partially install the elevator system in the elevator shaft;

checking that the established installation steps can be carried out by the automated mounting device via a computer-aided simulation tool;

detecting several actual dimensions of the elevator shaft via an automated measuring system, the automated system having a camera;

deriving an actual layout of the elevator system from the target layout of the elevator system and the detected actual dimensions of the elevator shaft via a digital model;

planning automated installation steps on the basis of the actual layout of the elevator system and the established installation steps that can be carried out by the automated mounting device;

arranging the automated mounting device in the elevator shaft;

determining a position of the automated mounting device by a reference element arranged in the elevator shaft; and carrying out the automated installation steps with the automated mounting device.

* * * * *